US005643059A

United States Patent [19]

Chen

[11] Patent Number: 5,643,059

[45] Date of Patent: Jul. 1, 1997

[54] RECIPROCATING GRINDER

[75] Inventor: Chao-Hsin Chen, Fong Yuen, Taiwan

[73] Assignee: American Machine & Tool Company, Inc. of Pennsylvania, Royersford, Pa.

[21] Appl. No.: 421,203

[22] Filed: Apr. 13, 1995

[51] Int. Cl.[6] ..... B24B 9/04; B24B 7/00

[52] U.S. Cl. ..... 451/164; 451/45; 451/349; 451/356

[58] Field of Search ..... 451/45, 162, 164, 451/166, 367, 349, 356

[56] References Cited

U.S. PATENT DOCUMENTS

| | | | |
|---|---|---|---|
| 451,801 | 5/1891 | Bransgrove | 451/164 |
| 456,938 | 8/1891 | Clapp | 451/164 |
| 945,137 | 1/1910 | Olds | 451/164 |
| 1,930,383 | 10/1933 | Capellman, Sr. | 451/164 |
| 2,088,056 | 7/1937 | Foster | 451/367 X |
| 2,142,105 | 1/1939 | Blankner | 451/164 |
| 2,324,025 | 7/1943 | Revell | 451/164 |
| 2,578,081 | 12/1951 | Miller et al. | 451/164 |
| 3,133,381 | 5/1964 | Freed | 451/164 |

*Primary Examiner*—Timothy V. Eley
*Attorney, Agent, or Firm*—Connolly & Hutz

[57] ABSTRACT

A grinding mechanism includes a track device horizontally arranged in a base, and a slide slidably engaged on the track device. A grinding material is secured on top of the slide and moved in concert with the slide. A gear is rotatably supported in the base and a roller is eccentrically secured to the gear for engaging with the slide. A motor is disposed in the base for rotating the gear. The slide and the grinding material are moved in a reciprocating action along the track device in order to conduct grinding operations.

9 Claims, 6 Drawing Sheets

RECIPROCATING GRINDER

BACKGROUND OF THE INVENTION

1. Field of the Invention

The present invention relates to a grinding mechanism, and more particularly to a grinding mechanism having a grinding means that is movable in a reciprocating movement.

2. Description of the Prior Art

Typical grinding stones are developed for grinding knives and scissors. The users have to move the knives against the grinding stones in a reciprocating movement in order to grind the knives. In order to improve the grinding operations, the typical grinding mechanisms are developed and comprise a grinding wheel which is rotatably supported in a housing for grinding objects. Normally, the grinding mechanisms are not good for grinding knives and scissors.

The present invention has arisen to mitigate and/or obviate the afore-described disadvantages of the conventional grinding mechanisms.

SUMMARY OF THE INVENTION

The primary objective of the present invention is to provide a grinding mechanism having a grinding means that is movable in a reciprocating movement for grinding knives and scissors.

In accordance with one aspect of the invention, there is provided a grinding mechanism comprising a base, a track means horizontally provided in the base, a slide slidably engaged on the track means, a grinding means secured on top of the slide, and means for moving the slide and the grinding means in a reciprocating action along the track means.

The moving means includes a gear rotatably supported in the base, a roller eccentrically secured to the gear, and means for rotating the gear, the slide includes an oblong hole vertically formed therein for slidably engaging with the roller such that the slide is moved along the track means in the reciprocating action when the gear is rotated.

The rotating means includes a motor secured in the base, the motor includes a spindle having an end portion extended outward of the motor, and a pinion secured to the end portion and engaged with the gear so as to rotate the gear.

The grinding means includes a plate secured on top of the slide, and a grinding material secured on top of the plate so as to be moved in concert with the slide in the reciprocating action.

The plate includes a peripheral portion having a plurality of clamping members extended upward therefrom for clamping the grinding material in place.

A cover is secured on top of the base, the cover includes a channel provided on top thereof for slidably receiving the grinding means and includes a peripheral slot formed around the channel for receiving a sponge material.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
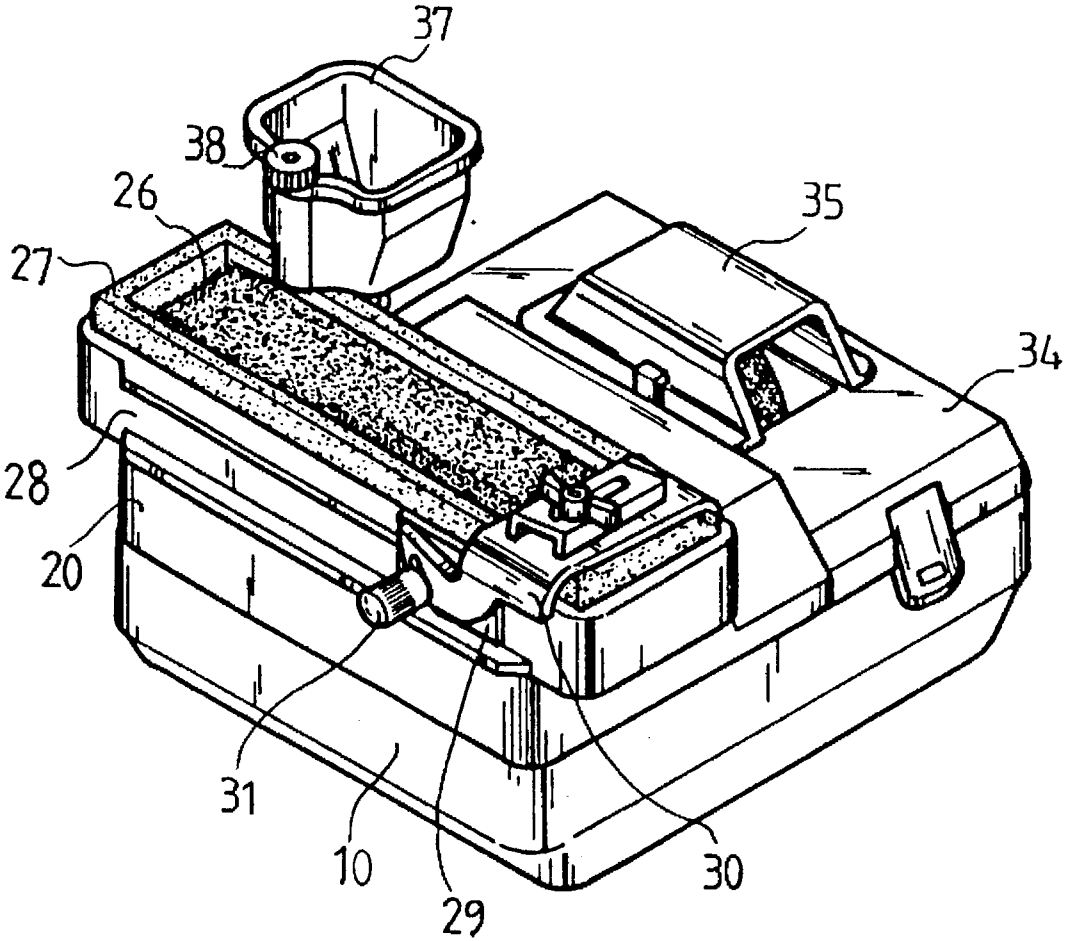
FIG. 1 is a perspective view of a grinding mechanism in accordance with the present invention.
Figure 2:
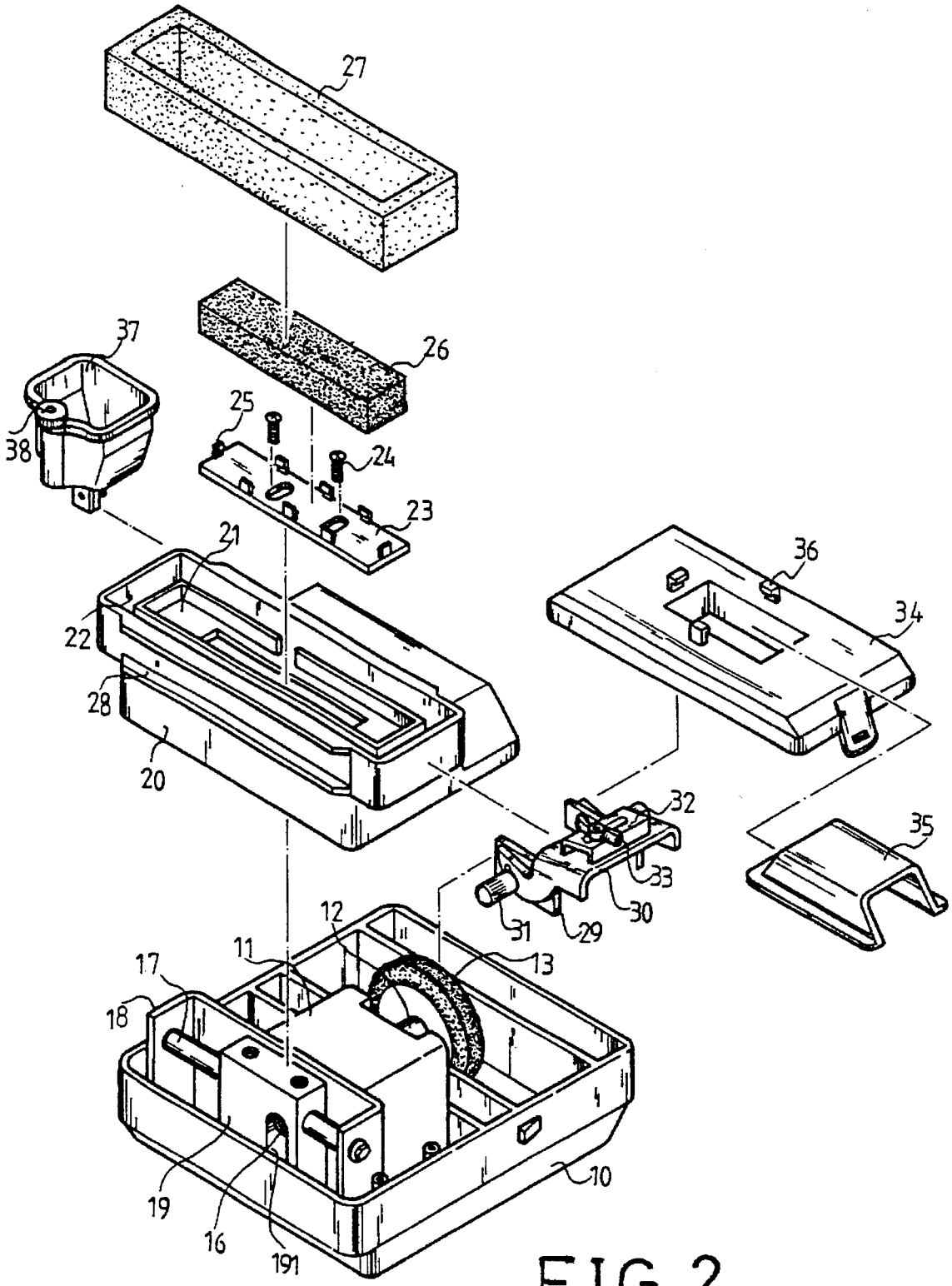
FIG. 2 is an exploded view of the grinding mechanism.
Figure 3:
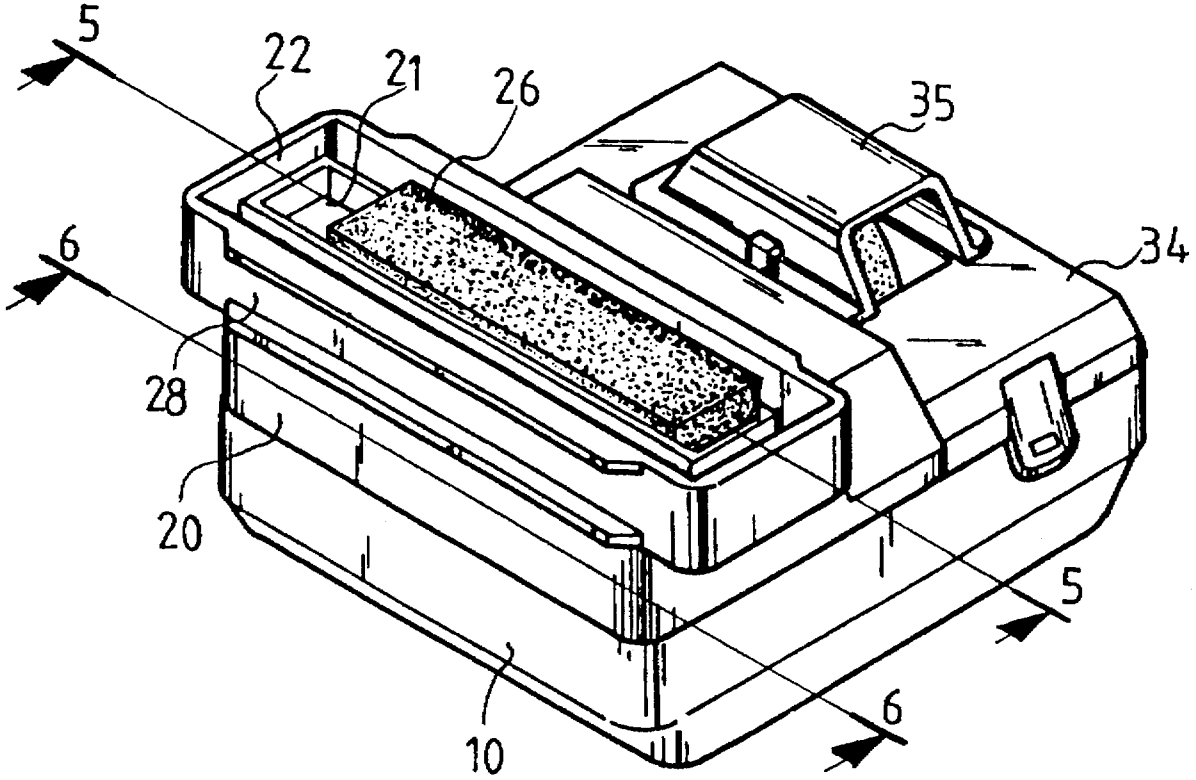
FIG. 3 is a perspective view of the grinding mechanism, in which a water supplying means and a knife supporting means are removed.
Figure 4:
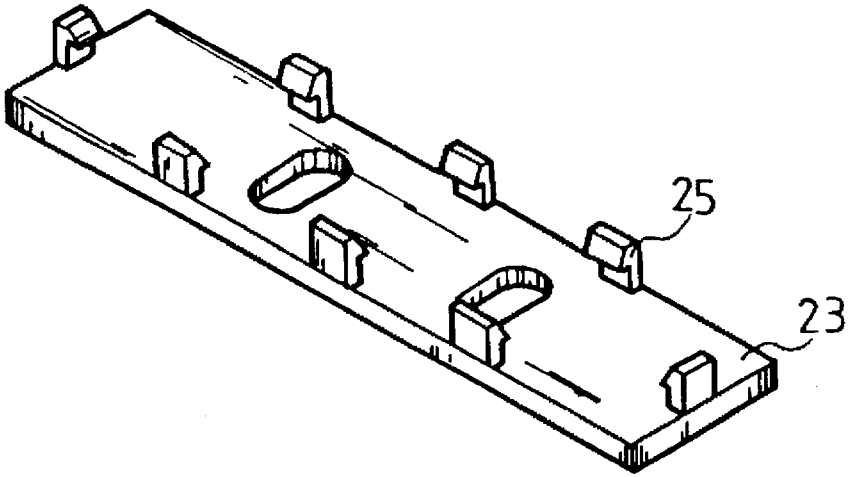
FIG. 4 is a perspective view showing a supporting means for a grinding material of the grinding mechanism.
Figure 5:
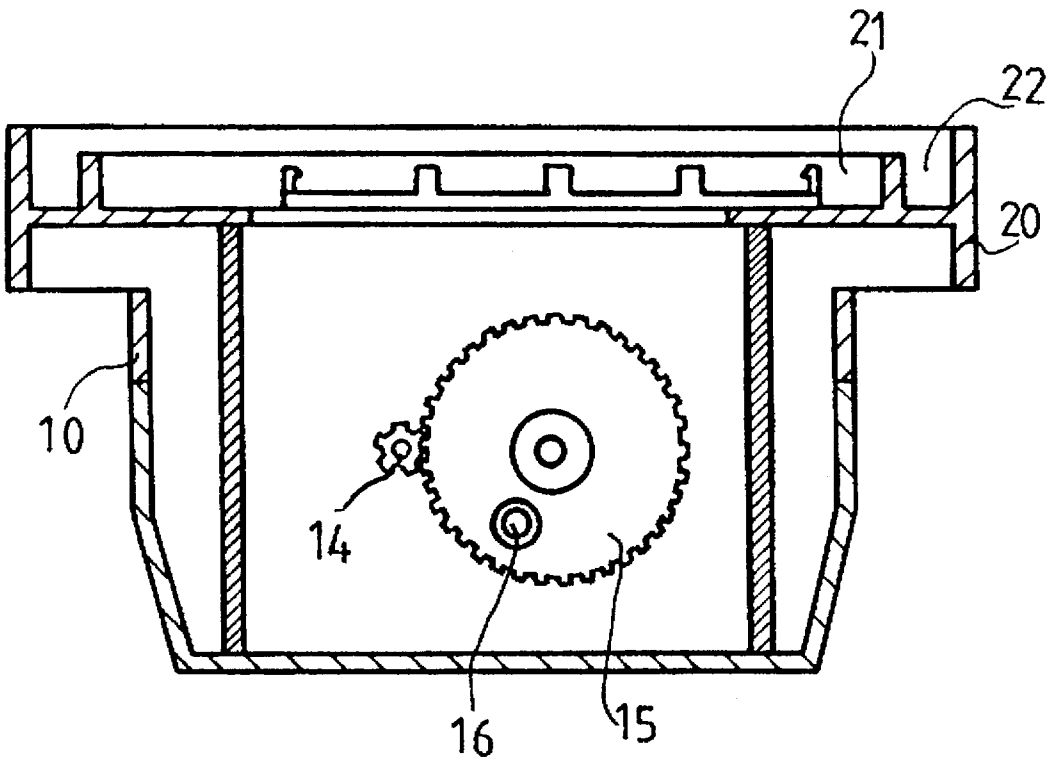
FIGS. 5 and 6 are cross sectional views taken along lines 5—5 and 6—6 of FIG. 3 respectively.
Figure 6:
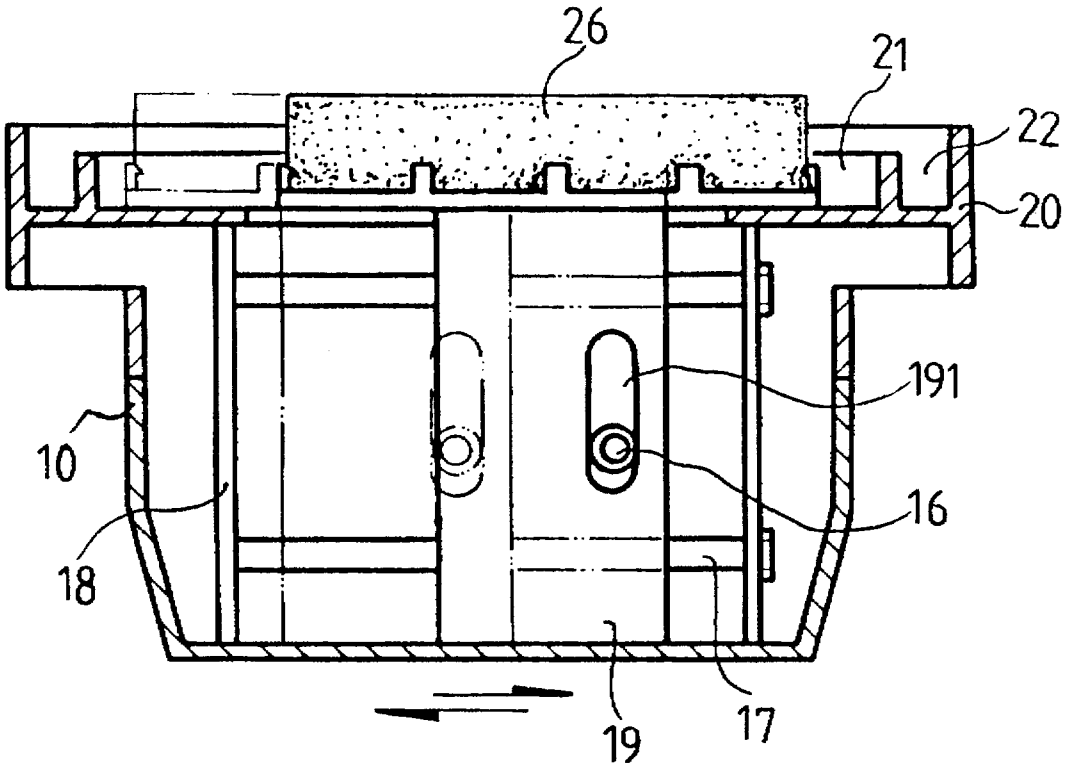

Referring to the drawings, and initially to FIGS. 1 to 4, a grinding mechanism in accordance with the present invention comprises a base 10 including a motor 11 disposed in the middle portion. The motor 11 includes a spindle 12 having two ends laterally extended outward of the motor 11. A grinding wheel 13 is secured to one end of the spindle 12 and may be rotated by the motor 11 for grinding purposes. As shown in FIG. 5, a pinion 14 is secured to the other end of the spindle 12. A gear 15 is rotatably coupled to the motor 11 and engaged with the pinion 14. A roller 16 is eccentrically secured to the gear 15. A frame 18 is secured in the base 10 close to the pinion 14 and the gear 15 and includes a pair of tracks 17 horizontally provided therein. A slide 19 is slidably engaged on the tracks 17 and movable along the tracks 17. The slide 19 includes an oblong hole 191 vertically formed therein for engaging with the roller 16 and arranged such that the slide 19 may be moved along the tracks 17 in a reciprocating movement by the roller 16 when the gear 15 is rotated by the motor 11. The roller 16 may move up and down relatively along the oblong hole 191 when the gear 15 is rotated and when the slide 19 is moved along the tracks 17, best shown in FIG. 6.

A cover 20 is secured on top of the base 10 for covering the motor 11 and the frame 18. The cover 20 includes a channel 21 provided on top thereof and a peripheral slot 22 provided around the channel 21 for engaging with a sponge material 27. A plate 23 is slidably engaged in the channel 21 and is fixed to the slide 19 by screw members 24 such that the plate 23 may be moved in a reciprocating action. As shown in FIG. 4, the plate 23 includes a number of clamping members 25 extended upward from the peripheral portion for clamping a grinding material 26 in place. The grinding material 26 may include grinding stones, grinding slips, grinding plates, grinding heads and grinding cloth engaged around a block. The grinding material 26 may thus be moved in a reciprocating action along with the slide 19. The cover 20 includes a pair of grooves 28 formed oppositely in the side portions thereof.

A knife support 29 includes two side portions slidably engaged in the grooves 28 and includes a bracket 30 rotatably supported thereon. A screw member 31 is provided for securing the bracket 30 to the knife support 29 to suitable angular position and may secure the bracket 30 to the cover 20. A clamping plate 32 is engaged on the bracket 30 and is secured to the bracket 30 by a screw member 33 so as to clamp a knife between the clamping plate 32 and the bracket 30. A cap 34 is engaged on top of the base 10 for covering the peripheral portion of the grinding wheel 13 and includes a number of clamping members 36 for securing a lid 35 to the cap 34. The lid 35 is provided for covering the upper portion of the grinding wheel 13. A container 37 is secured to the cover 20 and is located on top of the channel 21 for providing water to the grinding material 26 in order to facilitate grinding operations. The container 37 includes a valve means 38 for controlling the water quantity supplied to the grinding material 26. The sponge material 27 is provided for sucking water and for preventing water from dispersing.

Accordingly, the grinding mechanism in accordance with the present invention includes a grinding material 26 that may be moved in a reciprocating action for grinding knives and scissors.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A grinding mechanism comprising:

a base, a track means horizontally provided in said base, a slide slidably engaged on said track means, a grinding means secured on top of said slide, means for moving said slide and said grinding means in a reciprocating action along said track means, a cover secured on top of said base, and said cover including a channel provided on top thereof for slidably receiving said grinding means and including a peripheral slot formed around said channel.

2. A grinding mechanism according to claim 1, wherein said moving means includes a gear rotatably supported in said base, a roller eccentrically secured to said gear, and means for rotating said gear, said slide includes an oblong hole vertically formed therein for slidably engaging with said roller such that said slide is moved along said track means in said reciprocating action when said gear is rotated.

3. A grinding mechanism according to claim 2, wherein said rotating means includes a motor secured in said base, said motor includes a spindle having an end portion extended outward of said motor, and a pinion secured to said end portion and engaged with said gear so as to rotate said gear.

4. A grinding mechanism according to claim 1, wherein said grinding means includes a plate secured on top of said slide, and a grinding material secured on top of said plate so as to be moved in concert with said slide in said reciprocating action.

5. A grinding mechanism according to claim 4, wherein said plate includes a peripheral portion having a plurality of clamping members extended upward therefrom for clamping said grinding material in place.

6. A grinding mechanism comprising a base, a track means horizontally provided in said base, a slide slidably engaged on said track means, a grinding means secured on top of said slide, means for moving said slide and said grinding means in a reciprocating action along said track means, said grinding means including a plate secured on top of said slide, a grinding material secured on top of said plate so as to be moved in concert with said slide in said reciprocating action, a cover secured on top of said base, said cover including a channel provided on top thereof for slidably receiving said grinding means, and including a peripheral slot formed around said channel for receiving a sponge material.

7. A grinding mechanism according to claim 6, wherein said moving means includes a gear rotatably supported in said base, a roller eccentrically secured to said gear, and means for rotating said gear, said slide includes an oblong hole vertically formed therein for slidably engaging with said roller such that said slide is moved along said track means in said reciprocating action when said gear is rotated.

8. A grinding mechanism according to claim 7, wherein said rotating means includes a motor secured in said base, said motor includes a spindle having an end portion extended outward of said motor, and a pinion secured to said end portion and engaged with said gear so as to rotate said gear.

9. A grinding mechanism according to claim 6, wherein said plate includes a peripheral portion having a plurality of clamping members extended upward therefrom for clamping said grinding material in place.

* * * * *